United States Patent [19]

Sakuma et al.

[11] Patent Number: 4,915,040

[45] Date of Patent: Apr. 10, 1990

[54] SUIT MATERIAL SUPPORT DEVICE

[75] Inventors: Kuniharu Sakuma, Saitama; Hiroshi Honda; Koukichi Maehata, both of Tokyo; Takayuki Aikawa, Tokyo, all of Japan

[73] Assignee: Agency of Industrial Science and Technology, Tokyo, Japan

[21] Appl. No.: 299,568

[22] Filed: Jan. 18, 1989

[30] Foreign Application Priority Data

Jun. 1, 1988 [JP] Japan ..... 63-132866

[51] Int. Cl.[4] ..... D05B 23/00; D05B 21/00; D05B 3/00

[52] U.S. Cl. ..... 112/2; 112/63; 112/121.12; 112/121.14; 112/121.26; 112/104; 112/262.3

[58] Field of Search ..... 112/2, 63, 121.15, 121.24, 112/121.26, 10, 11, 121.11, 121.12, 104, 121.14

[56] References Cited

U.S. PATENT DOCUMENTS

| | | | |
|---|---|---|---|
| 2,766,709 | 10/1956 | Stevens, Jr. | 112/63 |
| 4,467,733 | 8/1984 | Martin | 112/2 |
| 4,506,611 | 3/1985 | Parker et al. | 112/63 X |
| 4,685,407 | 8/1987 | Junemann | 112/121.12 |

FOREIGN PATENT DOCUMENTS

| | | | |
|---|---|---|---|
| 2216373 | 11/1972 | Fed. Rep. of Germany | 112/2 |
| 956.315 | 9/1944 | France . | |
| 63-29691 | 2/1988 | Japan . | |
| 63-77484 | 4/1988 | Japan | 112/63 |
| 2129283A | 4/1984 | United Kingdom . | |

OTHER PUBLICATIONS

World Patent Abstracts, 88-074832 (11).
World Patent Abstracts, 88-074833 (11).

*Primary Examiner*—H. Hampton Hunter
*Attorney, Agent, or Firm*—Wenderoth, Lind & Ponack

[57] ABSTRACT

A suit material support device which comprises a center suit coat body support member and a pair of suit sleeve support members disposed on the opposite sides of the suit body support member. The suit coat body support member is rotatable from a suit coat body placing position and to right- and left-hand suit sleeve sewing positions. It has a plurality of suit body bars displaceable in planes intersecting each other at right angles and clamp needles for clamping suit sleeves against the suit body bars. A pair of suit sleeve support members are disposed on opposite sides of the suit body support member and each is rotatable between a suit sleeve attaching position and a suit sleeve placing position as the mechanism rotates. It has a plurality of sleeve bars movable for accommodating variation in the size of the suit sleeves and is displaceable in the plane of the axis of rotation of the suit sleeve support member to move the sleeve thereon into position for attachment to a suit coat body on the body support member.

3 Claims, 11 Drawing Sheets

SUIT MATERIAL SUPPORT DEVICE

BACKGROUND OF THE INVENTION

This invention relates to three-dimensional sewing of suit coats, blazers and the like and more particularly, to a support method and a support device for supporting the material of the suit coats, blazers and the like in the three-dimensional sewing in such a manner that the suit material can be automatically, precisely and rapidly positioned in a proper sewing position.

To be used in connection with a suit sleeve attaching device which three-dimensionally sews the coat body and sleeves of a suit material as parts to be sewn together, the applicant of this application has developed the support devices C for supporting the coat body and sleeves of the suit material as shown in FIG. 11 (Japanese Patent Application Nos. 170886 and 170887/1986). In these support devices C, the right- and left-hand suit sleeves are placed from the sleeve edges onto right- and left-hand suit sleeve support portions D which can spread and contract like umbrella ribs. At this time, the umbrella rib-like support portions are in the contracted position. Next, the suit sleeve support portions are spread out as shown in FIG. 11 and forcibly hold the suit sleeves at the shoulders of the sleeves. The position of the suit coat body support portion E is adjusted with respect to the suit sleeve support portions D by moving the body support portion upwardly and downwardly to obtain a proper postion of the body support portion and when the proper position is attained the body support portion is stopped there. Thereafter, the suit coat body is placed onto the suit body support portion E. A robot having a small sewing machine at the leading end of its arm three-dimensionally sews the suit coat body and sleeves together.

However, the above-mentioned three-dimensional sewing presents the following problems:

(1) The suit sleeve support portions D have a complicated umbrella rib construction and the suit sleeves are placed from the sleeve edges onto the sleeve support portions. Thus, the circumferential length at the leading ends of the sleeve support portions D when the support portions are in the contracted position for receiving the suit sleeves in tension should be less than one third that of the support portions are when the sleeve support portions in the spread position. Since such a substantial contraction or deformation is required, the strength of the support bars constituting the sleeve support portions is reduced resulting in inaccurate positioning of the suit sleeves.

(2) Since the suit sleeve support portions D should contract to a substantially small size when the suit sleeves are placed thereon, the support bars for supporting the suit sleeves cannot provide a sufficiently broad support face for the suit sleeves resulting in unstable support of the suit sleeves (especially at areas thereof adjacent to the seam lines).

(3) Since the full length of the suit sleeve support portions D is inevitably long, it takes a long time to place the suit sleeves onto the sleeve support portions.

(4) The support bars of the suit sleeve support portions D and the suit coat body support portion E move in varying amounts to accommodate suit coat bodies and sleeves having different sizes. Thus, a suitable clamp mechanism cannot be provided whereby the suit coat body and sleeves are hard to fit on the support portions.

(5) Since the sleeve positioning time is included in the cycle time, the whole cycle time is made long.

(6) Since the suit coat body and sleeve support portions are combined together in a proper position by moving the suit coat body and sleeve support portions upwardly and downwardly relative to each other, it takes a long time until the support portions come together.

(7) After the suit coat body and sleeve support portions have come together in a proper position, the robot commences the sewing operation. During the sewing operation, the operator does not perform any work. Thus, a long idle time is involved between the operation of the support device C and further action by the operator.

(8) Since a plurality of support bars should be independently driven in order to tightly hold the suit sleeves under tension and the support bars should be provided with individual motors, the suit coat body and sleeve support portions inevitably have an expensive and complicated construction. And since the position of each of the support bars should be determined individually, it takes a long time to determine the position of the support bars.

SUMMARY OF THE INVENTION

In order to solve the problems inherent in the prior arts referred to hereinabove, according to the present invention, each of the suit sleeve support portions can support a suit sleeve having a long arm hole circumferential length at the shoulder thereof. Thus, the suit sleeve support face of the suit sleeve support bar can be made broad. Furthermore, in order to suitably support the sewn area of the suit sleeve, the sleeve bars can support the gathering sewn area from the inner surface of the sleeve. In addition, during the time sewing operation is being performed by the robot, the operator can provide the sequence for performing the suit sleeve supporting operation preparatory for the next sewing operation to thereby shorten the whole cycle time.

The suit sleeve support member supports a suit sleeve having a long arm hole circumferential length at the shoulder thereof whereby the suit sleeve support portion of the suit material support device presents a broad support face for the suit sleeve. The sleeve support portion supports substantially the whole length of the inner surface of the sleeve edge. The robot performs the sewing operation independently of the suit sleeve supporting operation whereby the sleeve supporting operation and sewing operation can be related to each other to thereby shorten the whole cycle time.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the invention to the same.

PREFERRED EMBODIMENT OF THE INVENTION

The present invention will be now described referring to the accompanying drawings.

Figure 1:
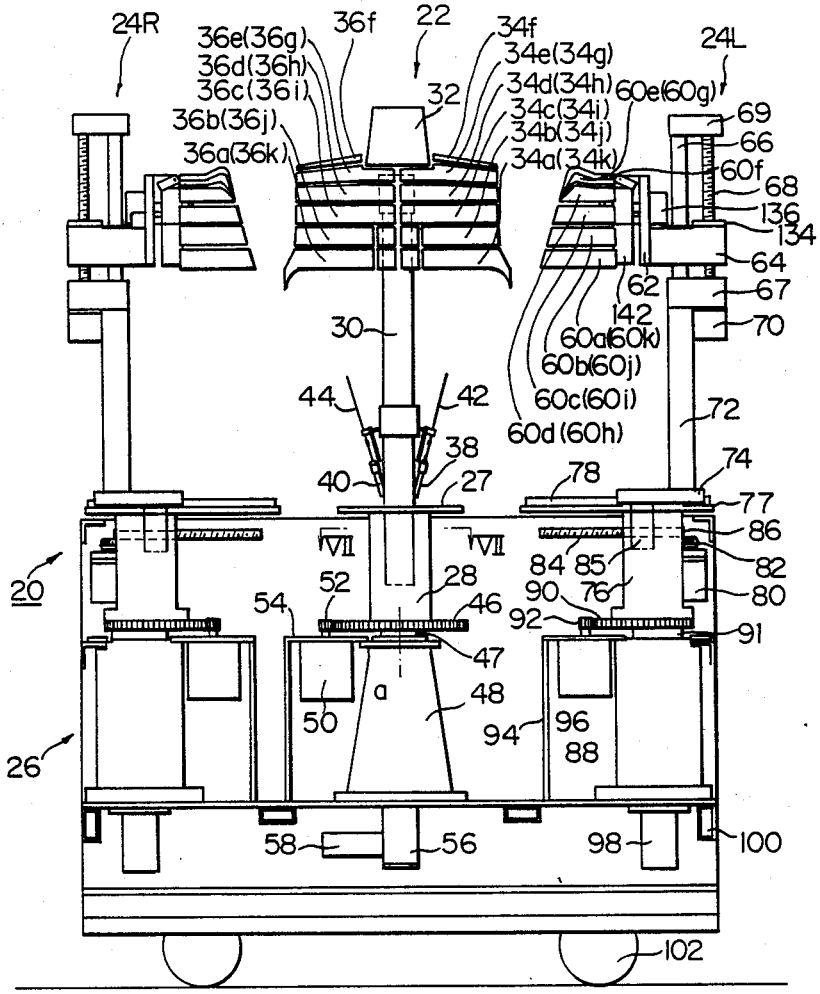
FIG. 1 is a schematic front elevational view of the suit material support device embodying the present invention.

FIG. 1 is a schematic view of the suit material support device 20 of the present invention. The suit material support device 20 comprises a central suit coat body support member 22, a pair of right- and left-hand suit sleeve support members 24R and 24L disposed on the opposite sides of the body support member 22 and a base 26 supporting the three support members. The suit sleeve support members 24R, 24L shown on the right- and left-hand sides of the body support member 22, respectively, are adapted to support the right- and left-hand sleeves of a suit and the two suit sleeve support members will be referred to as the right- and left-hand suit sleeve support members 24R and 24L, respectively, hereinafer.

Figure 7:
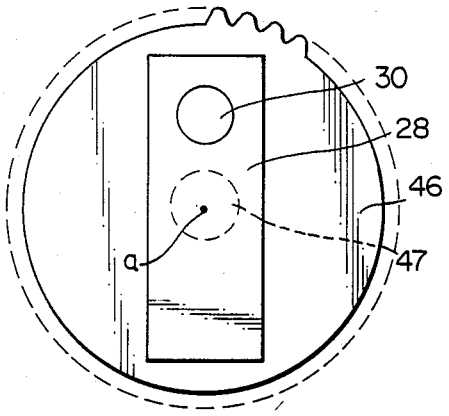
FIG. 7 is a sectional view taken along the line VII—VII of FIG. 1.

The body support member 22 has a body support member shaft 30 extending uprightly therefrom. The shaft 30 is connected at the lower end to the upper end of a suit body holder 28 through a support board 27. The suit body holder 28 is in the form of a block of rectangular cross section. A larger diameter spur gear 46 is provided about a lower portion of the holder 28. The suit body holder 28 is secured to the spur gear 46 so as to extend in the diametrical direction of the spur gear (see FIG. 7). The spur gear 46 is attached to a shaft 47 which is rotatably supported in a stationary pedestal 48 fixedly secured to the base 26. Also attached to the base 26 is a motor support member 54 on which a suit body rotating motor 50 is mounted. A pinion 52 is mounted on the output shaft of the motor 50 and meshes with the larger diameter spur gear 46 so that the body support member 22 can rotate about the shaft 47 as the motor 50 rotates.

Figure 2:
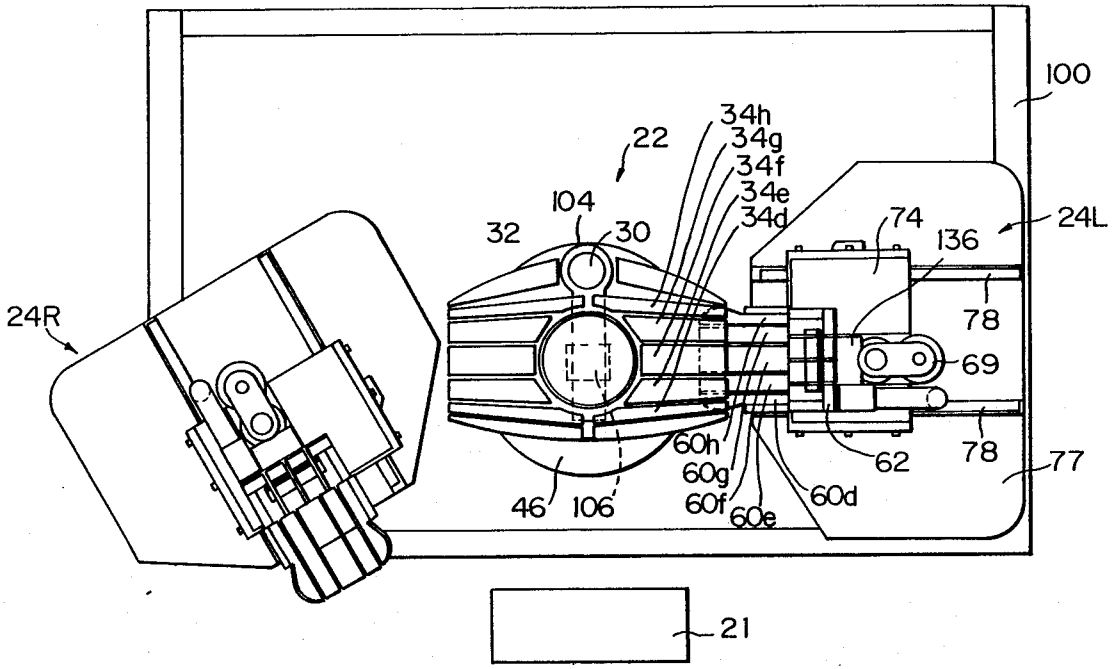
FIG. 2 is a schematic top plan view of the suit support device shown in FIG. 1 in which one sleeve support member faces the operation station and the other sleeve support member faces and engages the suit coat body support member.
Figure 3:
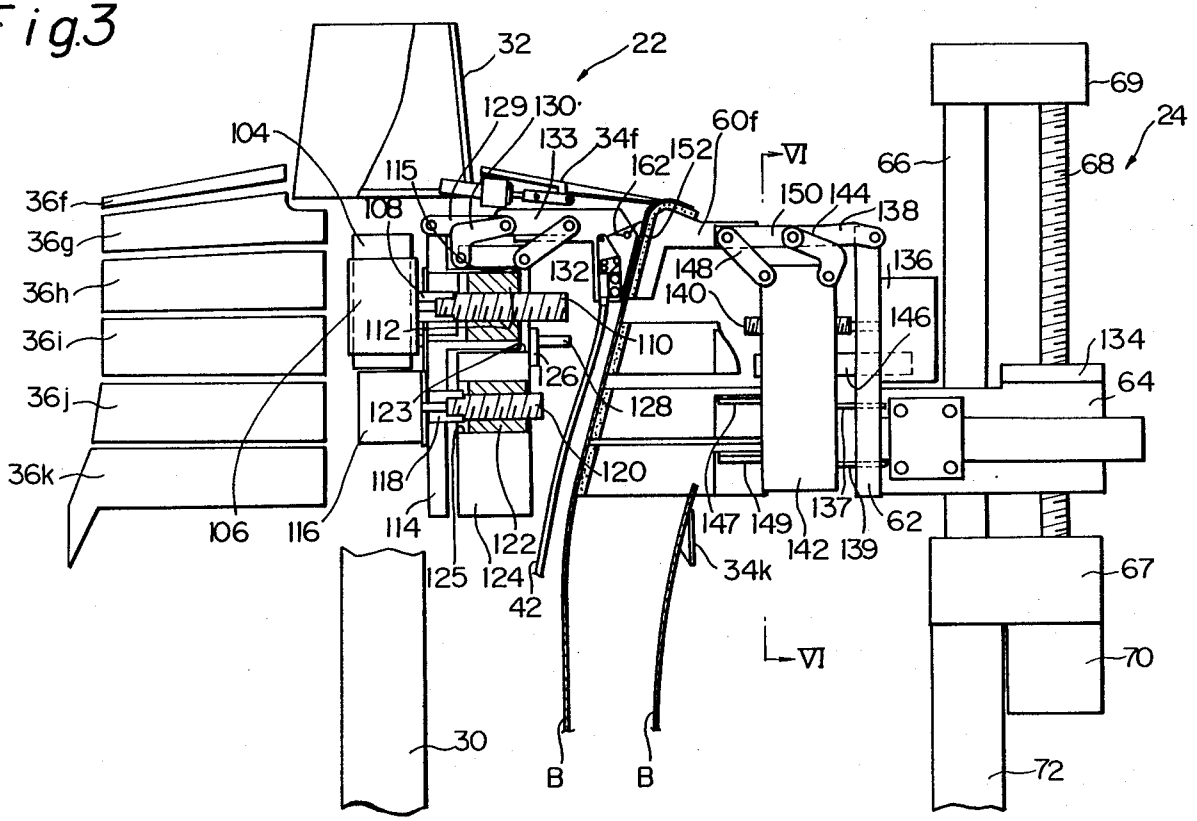
FIG. 3 is a side elevational view of the suit material support device with a portion thereof cut away showing the body and sleeve support members in the combined position.
Figure 5:
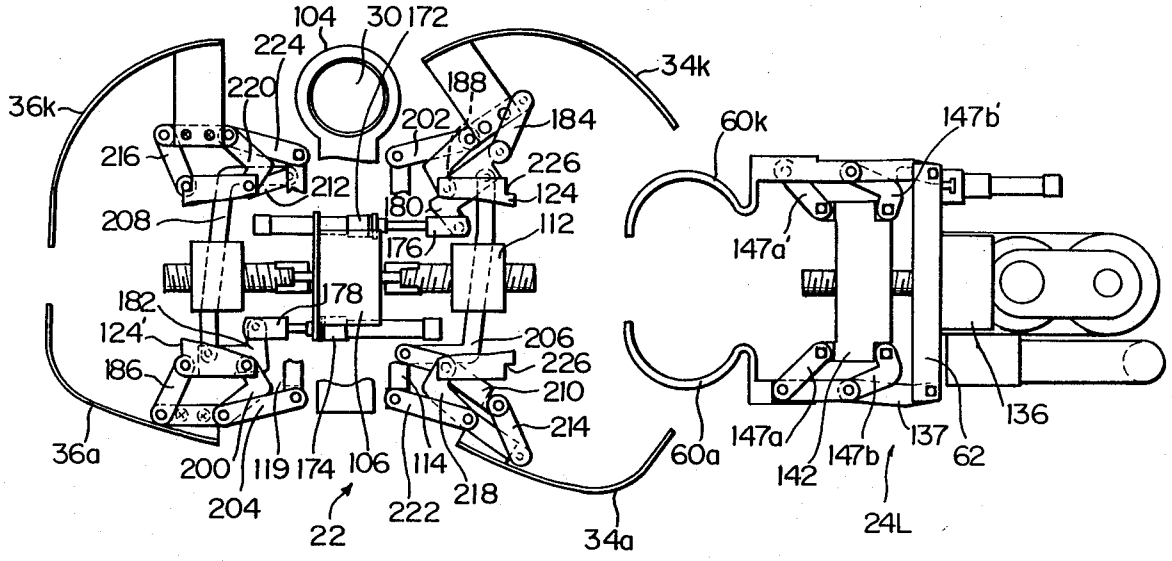
FIG. 5 is a fragmentary top plan view showing the condition just before one sleeve support member engages the suit coat body support member.

A machine framework 104 is mounted on an upper portion of the shaft 30 and extends horizontally therefrom (see FIGS. 2, 3, 5). A support 32 is attached to the machine framework 104 coaxial with the vertical axis a of the above-mentioned shaft 47 for supporting the suit coat body A at an area adjacent to the neck of the suit coat body. Provided on the opposite sides of the machine framework 104 in opposition to the suit sleeve support members 24R, 24L, respectively below the support 32 are two groups of suit body bars each group comprising eleven bars 36*a*–36*k* and 34*a*–34*k*, respectively, for example and the bars are arranged in a substantially horseshoe fashion as seen from side. A plurality of air cylinders 38, 40 are attached to the above-mentioned shaft 30 above a support board 27. The air cylinders 38, 40 have outer casings 42, 44 attached thereto, respectively. Suction tubes 56, 58 are attached to the undersurface of the stationary pedestal 48 which is positioned below the shaft 47 and in communication with a vacuum source (not shown).

Since the right- and left-hand suit sleeve support members 24R and 24L have substantially the same construction, but merely oriented in the opposite directions, description will be given of only the left-hand suit support member 4L with the understanding that the same is equally applied to the right-hand suit sleeve support member 24R. The left-hand suit sleeve support member 24L has a plurality of suit sleeve bars, that is, eleven suit sleeve bars 60*a*–60*k*, for example, which are in opposition to the suit body support bars 34*a*–34*k*, respectively and arranged substantially in a horseshoe fashion. These suit sleeve bars are attached to a movable suit sleeve bar carriage 64 through a suit sleeve bar link board 142 and a suit sleeve bar link board 62. A guide shaft 66 and a ball screw 68 are supported on the carriage 64. A ball nut 134 is in threaded engagement with the screw 68. A motor 70 is mounted at the lower end of the ball screw 68 through a holder board 67 whereby as the motor 70 rotates, the ball screw 68 rotates and the movable suit sleeve bar carriage 64 is guided along the guide shaft 66 to move upwardly and downwardly carrying the suit sleeve bars 60*a*–60*k* therewith. The guide shaft 66 and ball screw 68 are supported at the upper ends by a block 69. The suit sleeve bars 60*a*–60*k* and guide shaft 66 are supported by a suit sleeve support member shaft 72 the lower end of which is fixedly secured to a movable carriage 74. The carriage 74 is supported and guided on linear guide rails 78 which are held by a support board 77 fixedly secured to a suit sleeve support member pedestal 76. Fixedly secured to the pedestal 76 is a sleeve moving motor 86 which has a bevel gear 82 fixedly secured thereto. The gear 82 meshes with a bevel gear 86 which is attached to one end of a ball screw 84. Further attached to the movable carriage 74 is a ball nut 85 which meshes with the ball screw 84 whereby as the motor 80 rotates, the carriage 74 moves rightwards and leftwards on the rails 78.

The suit sleeve support member pedestal 76 has a spur gear 90 at the lower end thereof and the gear 90 is supported by a pedestal 88 supported on the base 26 by means of a stub shaft 91 and meshes with a smaller diameter spur gear 94 which is mounted on a motor 96 supported on a motor support member 94 which is fixedly secured at the lower end to the base 26. Thus, as the motor 96 rotates, both the suit sleeve support member pedestal 76 and suit sleeve support member 24L in unison rotate on the pedestal 88 about the shaft 91. Reference numeral 98 denotes a suction tube and reference numeral 100 denotes the framework constituting the base 26. The suit material support device 20 can move freely by means of wheels 102 provided on the undersurface of the base 26.

FIG. 2 is a schematic top plan view of the suit material support device 20 of the invention. From this figure, it is understood that as the motor 96 rotates, the suit sleeve support member 24L can rotate on the pedestal 88 about the shaft 91 and as the motor 80 rotates, the suit sleeve support member 24L can move freely along the rails 78 to engage with the center suit coat body support member 22. In FIG. 2, reference numeral 21 schematically shows the operation station where the operator places the suit coat body A and suit sleeves B onto the body and sleeve support members, respectively and remove the complete products from the support members. A sewing robot F having a small size sewing machine which is per se known (FIG. 14) is disposed on the side of the suit material support device opposite to the side of the device where the operation station 21 is provided.

Figure 8:
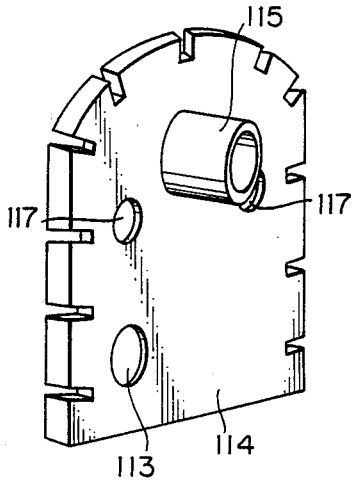
FIG. 8 is a perspective view of one body bar connection board.
Figure 9:
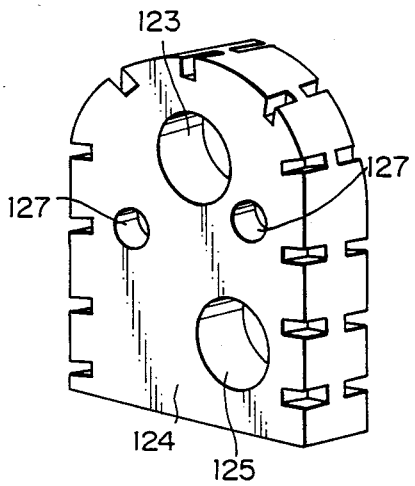
FIG. 9 is a perspective view of one arm hole link board.

FIG. 3 is a fragmentary sectional view showing the center suit coat body support member 22 and left-hand suit sleeve support member 24L in the sleeve attaching condition. A machine framework 104 is fixedly secured to the body support member shaft 30. The machine framework 104 has a shoulder length motor 106 attached thereto. Although the relationship between the body support member 22 and the left-hand suit sleeve support member 24L will be explained hereinafter, it should be understood that the relationship between the body support member 22 and right-hand suit sleeve support member 24R is substantially the same as that between the body support member 22 and the left-hand sleeve support member 24L. The output shaft projecting rightwardly from the shoulder length motor 106 has a ball screw 110 fixedly secured thereto through a joint 108 and a ball nut 112 is in threaded engagement with the ball screw 110. The output shaft (not shown) projecting leftwardly from the motor 106 has a ball screw mounted thereon the hand of which is opposite to that of the ball screw 110 and a ball nut (not shown). The ball nut 112 is secured within a sleeve 115 projecting from a suit body bar connection board 114 as shown in FIG. 8. The connection board 114 has an arm hole motor 116 fixedly secured thereto. The drive shaft of the arm hole motor 116 has a ball screw 120 secured thereto through a joint 118 extending through a through hole 113 in the connection board 114. A ball nut 122 is in threaded engagement with the ball screw 120 and fixedly secured within a through hole 125 in an arm hole link board 124 (FIG. 9). The arm hole link board 124 is provided with a through hole 123 above the through hole 125 for receiving the sleeve 115 projecting from the suit body bar connection board 114. The board 124 also has a pair of linear bearings 126 at a substantially central area thereof. The bearings 126 guide a pair of stationary shafts 128 having one end fixedly secured to the machine framework 104 through the through holes 117 in the suit body bar connection board 114 and the through holes 127 in the arm hole link board 124 whereby as the motors 106, 116 rotate, the suit body bar connection board 114 and arm hole link board 124 move independently of each other transversely of the machine framework 104 to contact each other and separate from each other. The periphery of the suit bar connection board 114 is provided with a plurality or eleven grooves or notches, for example. Eleven links 129 (only one link 125 is shown in FIG. 3) are pivoted at one end to the grooves. Similarly, the periphery of the arm hole link board 124 is provided with a plurality of or eleven pairs of links 130, 132, for example (only one link is shown in FIG. 3). The other ends of the links 129, 130 and the other ends of the links 132 are pivoted to the left- and right-hand ends of plates 133 fixedly secured to the suit body bars 34, respectively. The other ends of these links can be, of course, directly pivoted to the suit body bars 34 in place of being pivoted to the plates 133. With the arrangement of the links, as the motor 116 rotate, the arm hole link board 124 separates from the suit body bar connection board 114 to thereby spread the suit body bars **34*a*–34*k*** out.

As more clearly shown in FIG. 3, a ball nut 134 is secured to the movable suit body sleeve bar board 64 of the suit sleeve support member 24L and meshes with the ball screw 68. Also secured to the movable board 64 is a suit sleeve bar link board to which a suit sleeve motor 136 is attached. The motor 136 has a ball screw 140 secured thereto. If necessary, a member such as joint 108 may be interposed between the motor 136 and ball screw 140. A ball nut similar to the ball nut 112 meshes with the ball screw 140 and is secured to a suit sleeve bar link board 142. The board 142 can move rightwards and leftwards along a guide shaft 146 one end of which is secured to the suit sleeve bar link board 62. This arrangement is substantially the same as the arrangement of the arm hole motor 116 and the arm hole link board 124 of the body support member 22. However, as is apparent to those skilled in the art, the joint 108 and ball nut 112 are not absolutely necessary parts of the suit material support device of the present invention, but it may be the arrangement in which the ball screw 110 is directly connected to the output shaft of the motor 106 and the ball screw 110 meshes with the female thread on the suit body bar connection board 114. The arrangement is also applicable to the relationship between the motor 116 and arm hole link board 124 and that between the motor 136 and suit sleeve bar link board 142.

The periphery of the suit sleeve bar link board 62 is similarly provided with a plurality of, that is, eleven grooves or notches similar to the grooves provided on the periphery of the suit body bar connectionn board 114. Furthermore, the peripheral edges on the opposite sides of the suit sleeve bar link board 142 are provided with a plurality of, that is, eleven pairs of grooves similar to those provided at the peripheral edges on the opposite sides of the arm hole link board 124. Eleven links (only three links 137, 138 and 139 are shown) and eleven pairs of links (only one pair of links 144, 148 and one pair of links 147, 149 of two other pairs of links are shown) are pivoted at one end to the peripheral edge grooves by suitable means. The other ends of the links 137, 138, 139, the other end of the link 144 and the other ends of the links 114 and the other ends of the links 147, 148, 149 among all the links are pivoted to the right- and left-hand ends of plates 150. There are eleven plates 150 to connect the eleven pairs of links (the links 144, 148, for example). Although each plate 150 is fixedly secured at the left-hand end to the associated suit sleeve bar 60, the other end of the plate can be directly pivoted to the suit sleeve bar 60. However, in such a case, the plate 150 can be eliminated by forming the suit sleeve bar longer. Thus, as the suit sleeve motor 136 rotates, the link board 142 moves leftwards as seen in FIG. 3 to spread the suit sleeve bars 60*a*–60*k* out through the links 144, 148 connected to the board 142.

Figure 4:
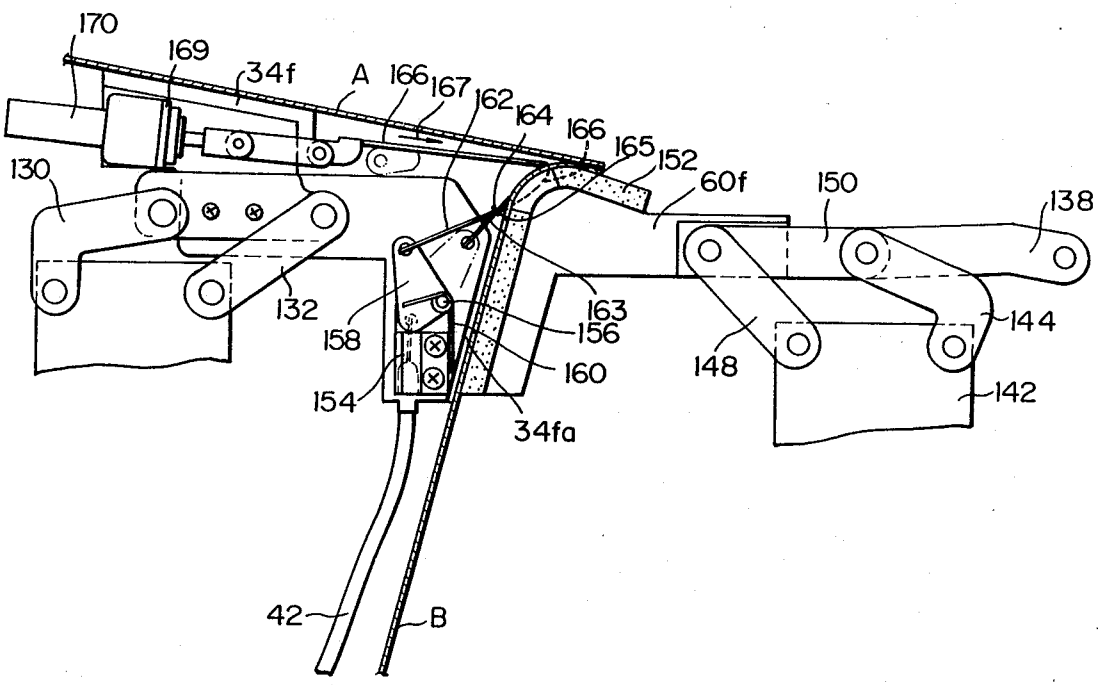
FIG. 4 is an enlarged view of a portion of FIG. 3.

FIG. 4 is an enlarged view of a portion of FIG. 3. As seen from this figure, the suit sleeve bar 60*f* is curved upwardly at an intermediate area between the opposite ends thereof to suitably support the gathered seam on the suit sleeve as a part of a suit coat and has a resilient material 152 such as rubber attached to the outer surface of the left-hand end of the suit sleeve bar 60*f*. The suit sleeve B placed on the suit sleeve support member 24 is guided to be pinched between the resilient material 152 and the suit sleeve support face 34*fa* and held there. In the position of the suit sleeve shown in FIG. 4, when the air cylinder 38 (FIG. 1) is operated, the wire 154 held within a casing 42 by means of holding means fixedly secured to the suit body bar 34*f* is pulled downwardly. Thus, the wire 154 secured at the upper end to a clamp plate 158 which is pivoted to the suit body bar 34F by means of a pin 156 rotates the clamp plate 158 in the counterclockwise direction against the force of a spring 160. However, when the air cylinder ceases to operate, the clamp plate 158 rotates about the pin 156 in the clockwise direction under the force of the spring 160. A clamp needle 162 is pivoted at one end to the clamp plate 158. The clamp needle 162 is guided at an area adjacent to the leading end thereof between pins 164, 165 attached to the suit body bar 34*f*. Thus, when the clamp plate 158 is biased by the spring 160, the leading end of the clamp needle 162 describes the curved broken line as shown by reference numeral 166 and the needle 162 moves to the position as shown by reference numeral 162. The portion of the resilient material 152 where the locus 166 is formed is cut away by the width of about 3 mm. As a result, the clamp needle 162 pierces through the suit sleeve from the outer side thereof and causes the inner side of the sleeve B against the suit sleeve support face 34*fa* of the suit body bar 34*f* by the resilient force of the spring 160. Furthermore, the suit body bar is provided at the leading end with a small hole (not shown) to which vacuum is applied from the vacuum source through the tubes 56, 58 whereby the suit sleeve B is firmly held in position by the spring and vacuum.

Figure 12:
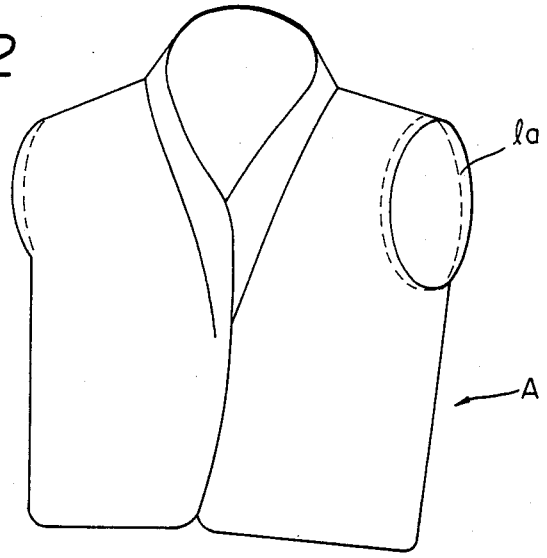
FIG. 12 is a view showing the body of a suit coat.
Figure 13:
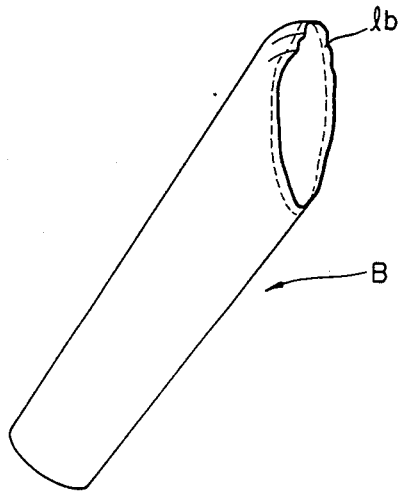
FIG. 13 is a view of a sleeve.

There is provided a suit body positioning plate 168 for serving as suit coat body positioning means when the suit body A is placed onto the body support member 22. A piston-cylinder 170 is connected to the inner end of the positioning plate 168 whereby the piston-cylinder 170 can move the positioning plate 168 from the solid line position shown in FIG. 4 rightwards in the arrow direction 167. The positioning of the suit coat body A is performed so as to align the outer end edges of the suit coat body and suit sleeve with each other when the outer end of the positioning plate 168 has moved to the rightmost position. In this way, the distance from the aligned end edges of the suit coat body and sleeve to the seam lines (la, lb in FIGS. 12 and 13), respectively, can be maintained constant. The piston-cylinder 170 is attached to the suit body bar 34*f* by an L-shaped securing member 169.

FIG. 5 is a top plan view showing the positional relationship between the suit coat body support member and sleeve support members 22 and 24L before the two support members engage with each other. The suit sleeve motor 136 rotates by a predetermined angular distance. When the suit sleeve motor 136 has rotated by the predetermined angular distance, the suit sleeve bar link board 142 has moved leftwards to a predetermined position. By the leftward movement of the suit sleeve bar link board 142, the linear links pivoted to the left- and right-hand sides of the board 142 (the links 147*a*, 147*a*′, for example) and the bent links (the links 147*b*, 147*b*′, for example) spread out outwardly to spread the suit sleeve bars 60*a*, 60*k* out and at the same time, the suit sleeve bar 60*f* (FIG. 3) spread out upwardly. The other suit sleeve bars similarly spread in a horsehoe fashion. Thus, suit sleeves having different sizes can be always positively held in position by varying the longer side length of the ellipse defined by the ends of the suit sleeve bars.

On the other hand, the body support member 22 has cylinders 172, 174 which extend and retract in the right- and left-hand directions, respectively and are disposed below a pair of suit body bar connection boards 114, 119, respectively. The cylinders 172, 174 respectively have knuckles 176, 178 at the leading ends of the piston rods slidable within the cylinders 172, 174, respectively. Substantially L-shaped operation links 180, 182 are pivoted at one end to the knuckles 176, 178, respectively. Linear links 184, 186 are pivoted at one end to the other ends of the operation links 180, 182, respectively. The operation links 180, 182 are pivoted at intermediate portions between the opposite ends of the links to a pair of arm hole link blocks 124, 124′ on the right- and left-hand sides of the shoulder length motor 106. It is preferably that the bent links 188, 200 are similarly pivoted at one end to the same pivot points of the links 180, 182 to the arm hole link blocks 124, 124′. The suit body bar 34k is pivoted to the other ends of the straight and curved links 184, 188 and the suit body bar 36*a* is pivoted to the other ends of the straight and curved links 186, 200, respectively. It is also preferably the levers 202, 204 are pivoted at one end to the pivot points of the suit body bars 34*k*, 36*a* to the curved links 188, 200, respectively. The levers 202, 204 are pivoted at the other ends to the suit body bar connection boards 114, 119, respectively, L-shaped interlocking links 206, 208 are pivoted at one end to the other ends of the operation links 180, 182, respectively. Second operation links 210, 212 are pivoted at one end to the interlocking links 206, 208, respectively. Straight links 214, 216 are pivoted at one end to the other ends of the second operation links 210, 212, respectively. The second operation links 210, 212 are pivoted at intermediate points between the opposite ends thereof to the arm hole links 124, 124′, respectively. It is further preferable that curved links 218, 220 are pivoted at one end to the pivot points of the second operation links to the arm hole link boards. And the suit body bar 34*a* is pivoted to the other ends of the straight and curved links 214, 218 and the suit body bar 36*k* is pivoted to the other ends of the straight and curved links 216, 220. Furthermore, it is preferable that the levers 222, 224 are pivoted at one end to the pivot connections between the curved links 218, 220 and suit body bars 34*a*, 36*k*, respectively. The levers 222, 224 are pivoted at the other ends to the sides of the suit body bar connection boards 114, 119 opposite to the sides of the suit body connection boards on which the levers 202, 204 are pivoted, respectively.

With the above-mentioned arrangement of the parts, as to the suit body support member 22, as the shoulder length motor 106 is driven, the suit body connection boards 114, 119 can move rightwards and leftwards respectively. And the arm hole motor 116 is driven, the arm hole link boards 124, 124′ can move rightwards and leftwards, respectively. As the arm hole link boards 124, 124' move as mentioned hereinabove, the suit body bars 34a–34k and 36a–36k can spread out into the shape of a horseshoe and close. In addition, as the cylinders 172, 174 operate, at least the suit body bars 34a–34k and 36a–36k can spread out further outwardly. The reason is that when the knuckle 176 moves rightwards as the cylinder 172 operates, the operation link 180 rotates in the counterclockwise direction and in connection with the rotation of the operation link 180, the interlocking link 206 rotates the second operation link 210 in the clockwise direction resulting in simultaneous spreading of the suit body bars 34a, 34k. And the recesses 226 formed on the opposite outer sides of the arm hole link boards 124, 124' receive one end of the straight links 184, 186, 214, 216, respectively.

Thus, in the suit body support member 22, the relationship of the suit body bars 34a–34k and 36a–36k to the arm hole link boards 124, 124' and suit body bar connection boards 114, 119, respectively is substantially the same as the relationship of the suit sleeve bars 60a–60k to the suit sleeve bar link boards 142 and suit sleeve bar link boards 62 in the suit sleeve support members 24R, 24L, respectively. Thus, as in the case of the suit sleeve support member 24, by varying the size of the shape of the horseshoe shape to be formed by one end of the suit body bars, suit bodies having different sizes can be always positively held in position. And variation in the size of the suit sleeve support member 24 can always conform with that in the size of the body support member 22 whereby the various conditions when the body support member and sleeve support members engage with each other remain unchanged even when the sizes of the members vary.

Figure 6:
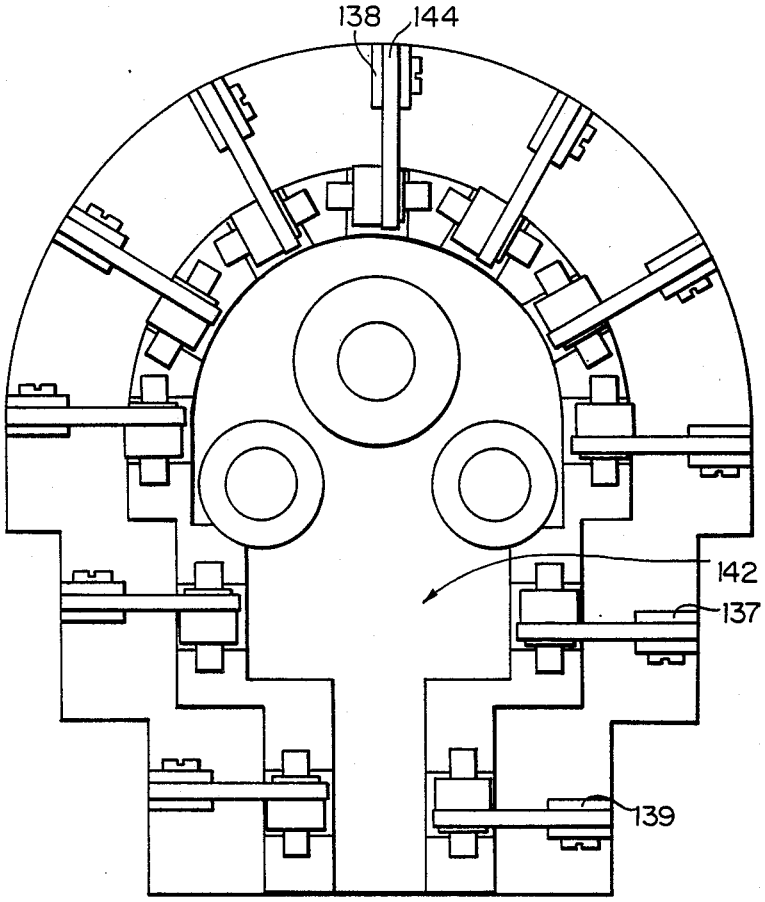
FIG. 6 is a sectional view taken along the line VI—VI of FIG. 3.

FIG. 6 is a schematic sectional view taken along the line VI—VI of FIG. 3. From this view, it will be understood that the suit sleeve bars 60a–60k are disposed in a horseshoe configuration about the suit sleeve bar link board 142. To rut more precisely, the suit sleeve bars 60c–60i disposed in an arc can move along a substantially normal line extending substantially radially from the center of the arc and on the other hand, the suit sleeve bars 60a, 60b, 60j, 60k disposed in a straight line can move substantially horizontally whereby the suit material to be procesed can be positively spread out. The other horseshoe dispositions are similar.

Figure 10:
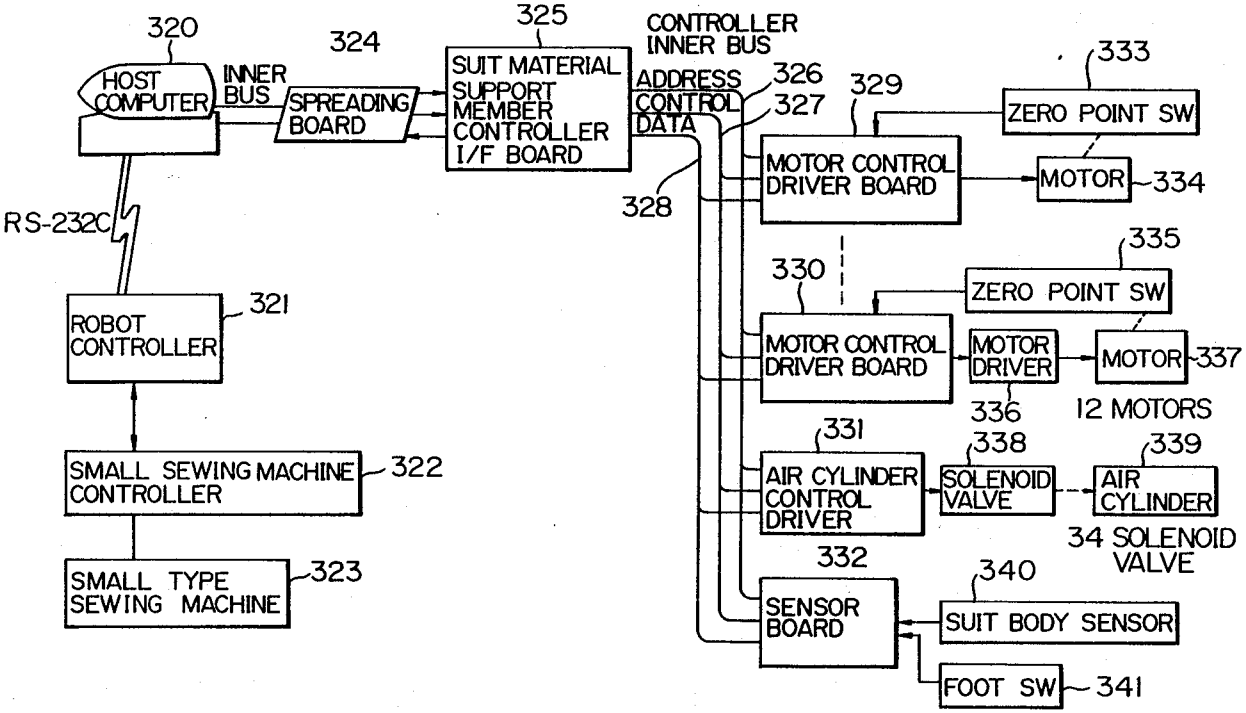
FIG. 10 is a diagram of the control system associated with the suit material support device of the present invention.
Figure 11:
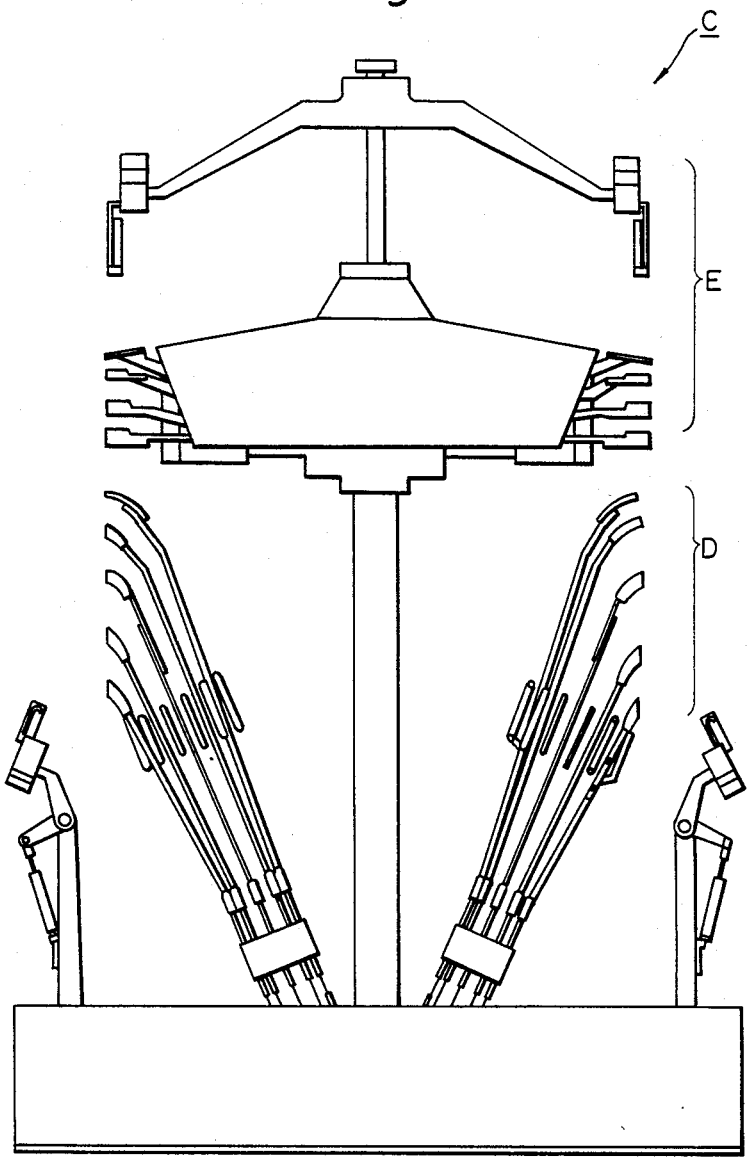
FIG. 11 is a front elevational view of a prior art suit material support device.
Figure 14:
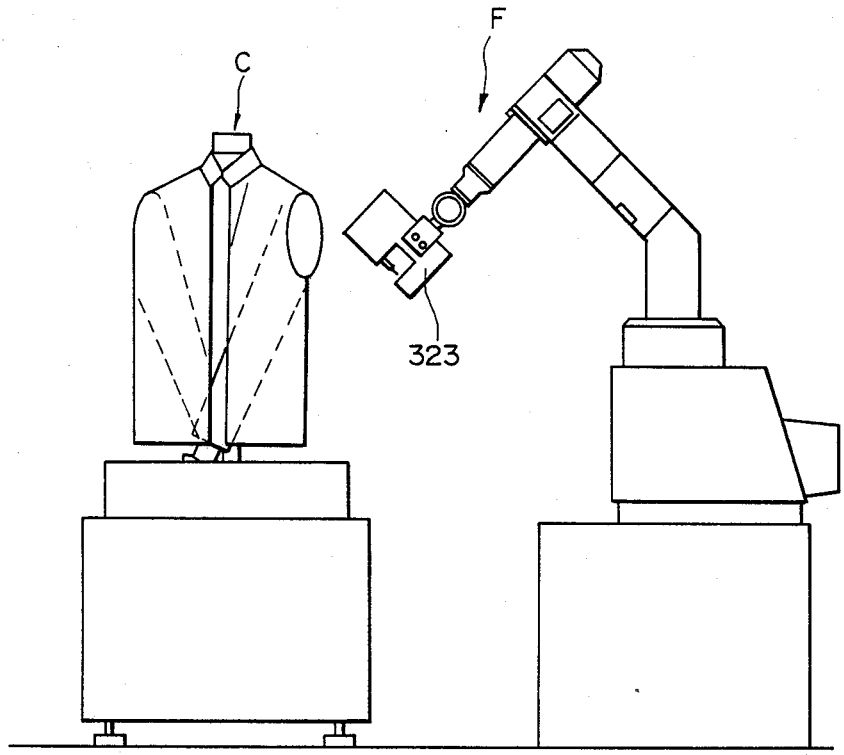
FIG. 14 is a view of the suit material support device of the present invention and its associated robot.

FIG. 10 is a block diagram of the control system incorporated in the suit material support device of the present invention and a host computer 320 principally performs the control function. That is, as shown in FIG. 14, the arm of the robot F has a small type sewing machine 323 which is per se known attached to the leading end of the arm. The sewing operation of the small sewing machine is controlled by a small sewing machine controller 322. Furthermore, the robot F is controlled by a controller 321 which controls the movement locus of the small sewing machine 323 in a three-dimensional space. The host computer 320 and robot controller 321 are electrically connected together by a circuit RS-232C to receive and transmit signals. The host computer 320 is connected to a suit material support member controller I/F board 325 through a spreading board 324. From the spreading board 325, the computer 320 is in succession connected to a motor control driver board 329, an air cylinder control board driver 331 and a sensor board 332 through the inner buses of an address bus 326, a control bus 327 and a data bus 328. The motor 334 is controlled with signals from a zero point SW333. A high output motor 337 is connected to a motor driver 336. And an optical suit body sensor 340 is provided adjacent to the neck support 32 (not shown in FIG. 3) and determine whether the suit coat body A is supported on the suit coat body support member 22 or not. A foot SW341 is provided to be operated by the operator for operating the suit coat material support members stepwise.

Now, the operation of the suit coat material support device of the present invention will be described.

First of all, the operator stands in the operation position or station 21. The motors 96 of the right- and left-hand suit sleeve support members 24R, 24L are operated to direct the support members toward the operator. The shoulders of the right- and left-hand suit sleeves B are placed onto the suit sleeve bars of the suit sleeve support members 24R, 24L. At this time, the portions of the shoulders of the suit sleeves B to be sewn with gathering are precisely disposed on the upwardly curved areas on the suit sleeve bars (see FIG. 3). The suit sleeve motors 136 are driven to the positions predetermined in conformity with the size of the suit sleeves to spread the suit sleeve bars 60a–60k out whereby the shoulders of the suit sleeves B are positively held in position in their spread condition. Next, the right- and left-hand sleeve vacuum sources are turned on. Thus, vacuum is applied to the vacuum tubes 98 through conduits (not shown) to the small holes at the leading ends of the right- and left-hand suit sleeve bars 60a–60k whereby the suit sleeve materials are attracted firmly to the faces of the bars as seen in FIG. 3. Thus, the suit sleeves are tightly sucked onto the resilient material 152 attached to the bars as shown in FIG. 3. The motors 96 in operation draw the right- and left-hand suit sleeve support members 24R, 24L towards each other. The motors 70 are driven whenever necessity arises to adjust the vertical positions of the suit sleeve support members. Thereafter, confirmation is made to determined that the previous sewing operation has completed and there is no suit material is present on the body support member 22. Next, the shoulder length motor 106 of the body support member 22 is driven to move the suit body bars 34a–34k and 36a–36k to the positions corresponding to the shoulder length of the suit body A. Next, the arm hole motor 116 is driven to spread the suit body bars 34a–34k and 36a–36k out to the maximum degree.

The right- and left-hand suit sleeve moving motors 80 are driven to move the right- and left-hand suit sleeve support members 24R, 24L towards the body support member 22 along the linear guide rails 78. At this time, among the suit body bars 34a–34k and 36a–36k, since the bars 34a, 34b, 34j, 34k and 36a, 36b, 36j, 36k lie in the movement paths of the suit sleeves B, the cylinders 172, 174 are actuated to retract these suit body bars lying on the movement paths from the movement paths of the suit sleeves so as to prevent interference with the passage of the suit sleeves (see FIG. 5). The right- and left-hand suit sleeve support members 24R, 24L (the right-hand suit sleeve support member 24R is not shown in FIG. 3) move towards the body support member 22 until the three support members engage with each other. When the cylinders 172, 174 are moved in the direction opposite to the previous direction to return the retracted suit body bars to the original positions (the left-hand side position in FIG. 5) and the suit body bars 34a–34k and 36a–36k which have spread out to the maximum degree are contracted to the position to conform with the size of the suit coat body A, the suit sleeve support faces 34*aa*–34*ka* of the suit body bars embrace the open upper ends of the suit sleeves B.

Normally, the clamp plates 158 provided on the suit body bars 34, 36 of the body support member 22 and positioned in the solid line position are moved to the broken line position (FIG. 4) under the resiliency of the springs 160 by relaxing the wires 154. The clamp needles attached to the clamp plates 158 move from the position shown by reference numeral 162 to the position shown by reference numeral 162 through the associated suit sleeve support faces describing the loci 166 (FIG. 4) whereby the clamp needles in the position 163 push the suit sleeves B from the suit sleeve bars 60*a*–60*k* towards the suit body bars 34*a*–34*k* and urge the suit sleeves B to abut against the suit sleeve support faces. A valve which is not shown and per se known is actuated to apply vacuum to the small holes (not shown) in the suit sleeve support faces through the suction tubes 56, 58 and a tube (not shown) and at the same time, terminate the application of vacuum to the suit sleeve support members 24 to the thereby firmly hold the openings at the upper ends of the suit sleeves B against the suit sleeve support faces of the suit body bars 34*a*–34*k* and 36*a*–36*k* for the suit body support member 22.

The rotation direction of the suit sleeve motors 136 is reversed to contract the suit sleeve bars 60 of the suit sleeve support members 24. The suit sleeve moving motors 80 are rotated in the reverse direction and at the same time, the motors 70 are driven so as to move the suit sleeve bars 60 and movable suit sleeve bar blocks 64 rightwards and upwardly as seen in FIG. 3. As a result, the suit sleeve support members 24 are moved from the suit body support member 22 to the position as shown in FIG. 1 without contacting the suit sleeves B held on the body support member 22. Thus, the upper ends of the two suit sleeves B are now firmly held at the leading ends of the suit body bars of the body support member 22.

The suit coat body A is turned inside out and placed onto the body support member 22 from the tops of the suit sleeves B so as to surround the sleeves (see FIG. 14). The suit coat body A in its turned-inside-out condition is positioned on the frusto-conical support 32 with the back of the suit coat body directed toward the operation station 21 (FIG. 2). The suit body rotation motor 50 is rotated to rotate the body support member 22 by 90° in the clockwise direction whereby the area adjacent to the seam line on the suit body can be directed to the operation station and the suit body can be precisely positioned onto the body support member. First, the motor 50 is driven by a foot switch (not shown), for example, to rotate the suit body support member 22 by 90° in the clockwise direction as seen in FIG. 2 to thereby direct the left-hand suit sleeve to the operation station 21. With the left-hand suit sleeve directed to the operation station 21, the arm hole board of the left-hand sleeve B an the arm hole of the suit body can be properly positioned. Since the suit body bar connection boards 114, 119 have been positioned in the position in conformity with the size of the suit coat body A by driving the shoulder length motor 106, the placement of the suit coat body onto the body support member 22 can be easily performed. The piston cylinder 170 is actuated to move the suit body positioning plate 168 by a predetermined distance in the arrow direction 167. Thus, the optimum sewing position of the suit coat body can be obtained by merely aligning the leading end of the suit body positioning plate 168 with the leading end of the arm hole of the suit coat body A. In this way, the seam line la on the suit coat body A and the seam lines lb on the suit sleeves B are aligned with each other. After the positioning operation, the vacuum source of the left-hand arm hole is turned on to perfectly hold the suit body A in position. Next, the motor 50 is actuated to rotate the suit body support member 22 by 180° in the counterclockwise direction and by repeating the procedure described in the positioning operation of the left-hand suit sleeve, the right-hand suit sleeve is directed to the operation station 21 and the vacuum source of the right-hand arm hole is turned on.

During the positioning of the right-hand suit sleeve, the sewing position of the right-hand suit sleeve is established and the left-hand suit sleeve is directed to the robot F. For sewing the left-hand suit sleeve B, the positioning plate 168 is rotated in the direction opposite to the arrow direction 167 and at the same time, the sewing machine 323 on the robot commences the sewing operation on the left-hand suit sleeve.

When the positioning of the right-hand suit sleeve and the sewing operation on the left-hand suit sleeve have been completed, the motor 50 is again driven to rotate the body support member by 180° in the clockwise direction. In this position of the body support member, the robot sews the right-hand suit coat sleeve to the suit body. Simultaneously with the commencement of the sewing operation, the suit sleeve bars 60 descend to a predetermined position by the rotation of the motors 70 in the reverse direction and the suit sleeve support members 4R, 24L rotate to face the operation station 21 as shown in FIG. 2 as described in connection with the right-hand suit sleeve support member 24R as the motor 96 rotates. Simultaneously, the suit sleeve bars 60 also move towards the operation station 21 as the motors 80 rotate. Thus, during the sewing operation by the robot, the operator can perform the placing of the suit sleeves onto the suit sleeve members for the next sewing operation. When the sewing on of the right-hand suit sleeve has been completed, the body support member 22 is returned to the position shown in FIG. 2, the application of vacuum is interrupted and the completely sewn suit coat can be removed from the body support member 22.

According to the present invention, when the suit sleeve is placed onto the suit sleeve support member, the shoulder of the sleeve is placed on the suit sleeve bars. Since the shoulder of the suit sleeve forms an arm hole substantially larger than the sleeve edge, the shoulder can be more easily placed onto the sleeve support member. Furthermore, since it is required to secure the sleeve only at an area adjacent to the suit sleeve support member, the placement operation can be performed in a quite simple manner and short time.

In order to secure the suit sleeve to the suit sleeve support member, it is only necessary that the circumferential length of the suit sleeve support member is made slightly smaller than that of the suit sleeve and the sleeve support face of the suit sleeve support bar can be made wide to thereby support the suit sleeve in a stabilized position.

The sewn area of the suit sleeve can be precisely positioned because the support levers and the upwardly curved portions are present inwardly of the edge of the material of the sleeve.

While the suit coat body and sleeves are being sewn together, the right- and left-hand suit sleeve members are in their initial condition so that the suit sleeves can be set for next sewing the operation to thereby shorten the overall cycle time.

While one preferred embodiment of the invention has been shown and described in detail, it will be understood that the same is for illustration purpose only and not to be taken as a definition of the scope of the invention, which scope is defined by the appended claims.

What is claimed is:

1. A suit material support device, comprising:

a suit coat body support member mounted for rotation about an axis from a suit coat mounting position to respective right and left hand sleeve sewing positions, a plurality of suit body bars displacably mounted on said body support member for displacement in the direction of the shoulder length of a body and substantially radially of said direction in a plane intersecting said direction of the shoulder length at right angles, said suit body bars having suit sleeve support faces and clamp needles for clamping suit sleeves against said suit sleeve support faces, and suit body bar displacement means for displacing said suit body bars;

a pair of suit sleeve support members disposed on opposite sides of said suit coat body support member and each mounted for rotation of the corresponding sleeve support member about an axis parallel to said axis about which said body support member is rotatable and from a suit sleeve attaching position to a suit sleeve placing position, a plurality of suit sleeve bars on each of said suit sleeve support members and movable in a lateral direction of the axis of rotation of the corresponding sleeve support member and movable substantially radially of said lateral direction for accommodating different size sleeves, and sleeve bar moving means for moving said suit sleeve bars radially for accommodating different size sleeves and for moving said suit sleeve bars laterally; and motor means for rotating said suit coat body support member and said suit sleeve support members around the respective axes of rotation, whereby after the pair of suit sleeve support members in suit sleeve placing positions have had suit sleeves placed thereon, said suit sleeve support members can be rotated to said suit sleeve attaching positions and said suit sleeve bars can be moved laterally toward said suit coat body supporting member for positioning the sleeves on said suit body bars, and then moved radially inwardly to release the sleeves, and after a suit coat body is placed on said body support member over the sleeves, said body support member can then be rotated to one of the right and left hand sleeve sewing positions for sewing the corresponding sleeve to the suit coat body, and can then be rotated to the other of the right and left hand sleeve sewing positions for sewing the corresponding sleeve to the suit coat body.

2. A suit material support device as claimed in claim 1 in which said suit sleeve bars have a shape for receiving only the shoulders of suit sleeves thereon.

3. A suit material support device as claimed in claim 1 in which said suit body bars and said suit sleeve bars are movable radially in a cross-sectional configuration which is generally horseshoe shaped.

* * * * *